US008302614B2

(12) United States Patent
Yoshida et al.

(10) Patent No.: US 8,302,614 B2
(45) Date of Patent: Nov. 6, 2012

(54) COMPACT CASE

(75) Inventors: Yuzo Yoshida, Tokya (JP); Yasuko Nakajima, Tokya (JP)

(73) Assignee: Yoshida Industry Co., Ltd., Tokyo (JP)

( * ) Notice: Subject to any disclaimer, the term of this patent is extended or adjusted under 35 U.S.C. 154(b) by 420 days.

(21) Appl. No.: 12/554,071

(22) Filed: Sep. 4, 2009

(65) Prior Publication Data

US 2010/0059081 A1 Mar. 11, 2010

(30) Foreign Application Priority Data

Sep. 10, 2008 (JP) ..... 2008-231683

(51) Int. Cl.
*A45D 33/20* (2006.01)

(52) U.S. Cl. ..... 132/287

(58) Field of Classification Search ..... 132/287, 132/293, 294, 315, 286, 295; 206/540, 581; 220/4.22, 827–830, 83, 263–264, 283, 835, 220/281

See application file for complete search history.

(56) References Cited

U.S. PATENT DOCUMENTS

2006/0196524 A1* 9/2006 Yuhara ..... 132/294
2007/0163919 A1* 7/2007 Yuhara et al. ..... 206/581
2007/0246060 A1* 10/2007 Yuhara et al. ..... 132/294

FOREIGN PATENT DOCUMENTS

JP 2007-289290 11/2007

* cited by examiner

*Primary Examiner* — Todd Manahan
*Assistant Examiner* — Brianne Kalach
(74) *Attorney, Agent, or Firm* — Clements Bernard PLLC; Christopher L. Bernard; Lawrence A. Baratta, Jr.

(57) ABSTRACT

A compact case with improved assembly and producibility, and stability in opening and closing the lid is provided. A compact case 1 comprises a body 2 having a bottom plate 25 with a pair of slots 27 formed therein at a front side part or a rear side part thereof along respective side walls 23, 24 of the body 2, and a pair of elastically deformable pushing walls 29 formed in the respective side walls 23, 24 facing the respective slots 27, a lid 3 rotatably provided to a rear wall 21 of the body 2, a cosmetic dish 4 that fits into the body 2 between the respective side walls 23, 24 and is slidable in a longitudinal direction of the body 2, a hook part 41 engaging the cosmetic dish 4 the lid 3 so as to hold the lid 3 at a closed position and to release the engagement through sliding movement of the cosmetic dish 4, a projection 26 integrally provided to an inner surface of the pushing wall 29, and a slope-defining part 42 integrally provided to the cosmetic dish 4 facing the projection 26. Squeezing the pushing wall 29 causes the projection 26 to move slidably to make the cosmetic dish 4 slide forward or rearward.

10 Claims, 12 Drawing Sheets

COMPACT CASE

CROSS-REFERENCE TO RELATED APPLICATIONS

The present application claims priority from Japanese Patent Application No. 2008-231683 filed on Sep. 10, 2008, the contents of which are herein incorporated by reference.

BACKGROUND

1. Technical Field

The present invention relates to a compact case having a body and a lid for covering the body, and more particularly, to a compact case in which engagement of a lid with a body can be released by squeezing respective side walls of the body.

2. Related Art

As a compact case in which engagement of a lid with a body can be released by squeezing respective side walls of the body, for example, one disclosed in Japanese Patent Laid-open Publication No. 2007-289290 has been known.

The compact case disclosed therein has a body with a pair of slits at a bottom plate part of the body extending in a longitudinal direction of side wall parts of the body, the side wall parts allowed to elastically deform inwardly in a body width direction, which enables inward pressing operation by the side wall parts. In the body is installed an inner dish that covers the bottom plate part. A channel part is formed in the bottom plate part covered with the inner dish, in which a thin plate-shaped sliding piece is provided. The sliding piece is caused to slide along the channel part as the elastically deformable side wall parts are squeezed. An engaging part that is provided at a front end of the sliding piece moves back and forth in accordance with sliding movement of the sliding piece and engages a projection provided to the lid to implement engageable and disengageable coupling between the body and the lid.

In the art disclosed in Japanese Patent Laid-open Publication No. 2007-289290, the sliding piece with the engaging part provided at the front end thereof is installed under the cosmetic dish as the inner dish in the body as a separate component so as to implement engageable and disengageable coupling between the body and the lid. Consequently, the number of components of the compact case increases, stability in operation of pressing the side walls is lacking, and manufacturing process is rendered more complicated.

SUMMARY

The present invention is made in view of the above and other problems, and an object thereof is to provide stable operability in opening and closing, improved assembly efficiency, and improved producibility of a compact case that enables releasing engagement between the body and the lid by squeezing the respective side wall parts of the body.

In order to accomplish the above and other objects, one aspect of the present invention is a compact case comprising a body having a bottom plate, a rear wall provided at a rear end of the bottom plate, pair of side walls provided at respective side ends of the bottom plate, a pair of slots formed in the bottom plate at a front side part or a rear side part thereof along the respective side walls, a pair of elastically deformable pushing walls formed in the respective side walls facing the respective slots, a lid provided to the rear wall of the body and rotatable with respect to the body, and a cosmetic dish that fits into the body between the respective side walls thereof and slidable in a longitudinal direction of the body, with a hook part provided between the cosmetic dish and the lid engageably and disengageably engaging the cosmetic dish with the lid so as to hold the lid at a closed position with respect to the body and to release the engagement of the cosmetic dish with the lid through sliding movement of the cosmetic dish, a projection integrally provided to one of an inner surface of the pushing wall and the cosmetic dish, and a slope-defining part facing the projection and integrally provided to one of the cosmetic dish and the inner surface of the pushing wall, wherein squeezing the pushing wall causes the projection to move slidably to make the cosmetic dish slide forward or rearward via the slope-defining part. Further, the slope-defining part may have a sloped surface abutting the projection, the sloped surface being inclined in a forward or a rearward direction of the body and the cosmetic dish.

In the above compact case, a plurality of the projections and a plurality of the slope-defining parts corresponding to the projections may be provided.

In the above compact case, a space may be defined between the cosmetic dish and the rear wall or the front wall of the container body and an elastically deforming member may be disposed in the space. The elastically deforming member is elastically deformed by the cosmetic dish when the cosmetic dish is slid forward or rearward and returns the cosmetic dish to a home position by force of elastic restoration.

In the above compact case, a hanging front wall may be provided to the lid at a front end thereof that covers an entire front surface of the front wall of the body.

According to the compact case of the present invention, in a compact case in which squeezing of the respective side walls releases engagement between the body and the lid, assembly can be simplified and productivity can be improved, and stability in opening and closing the lid thereof can be achieved.

Furthermore, a width between the side wall of the body and the cosmetic dish can be set smaller to give the compact case a superior design.

DESCRIPTION OF THE EMBODIMENTS

Figure 1:
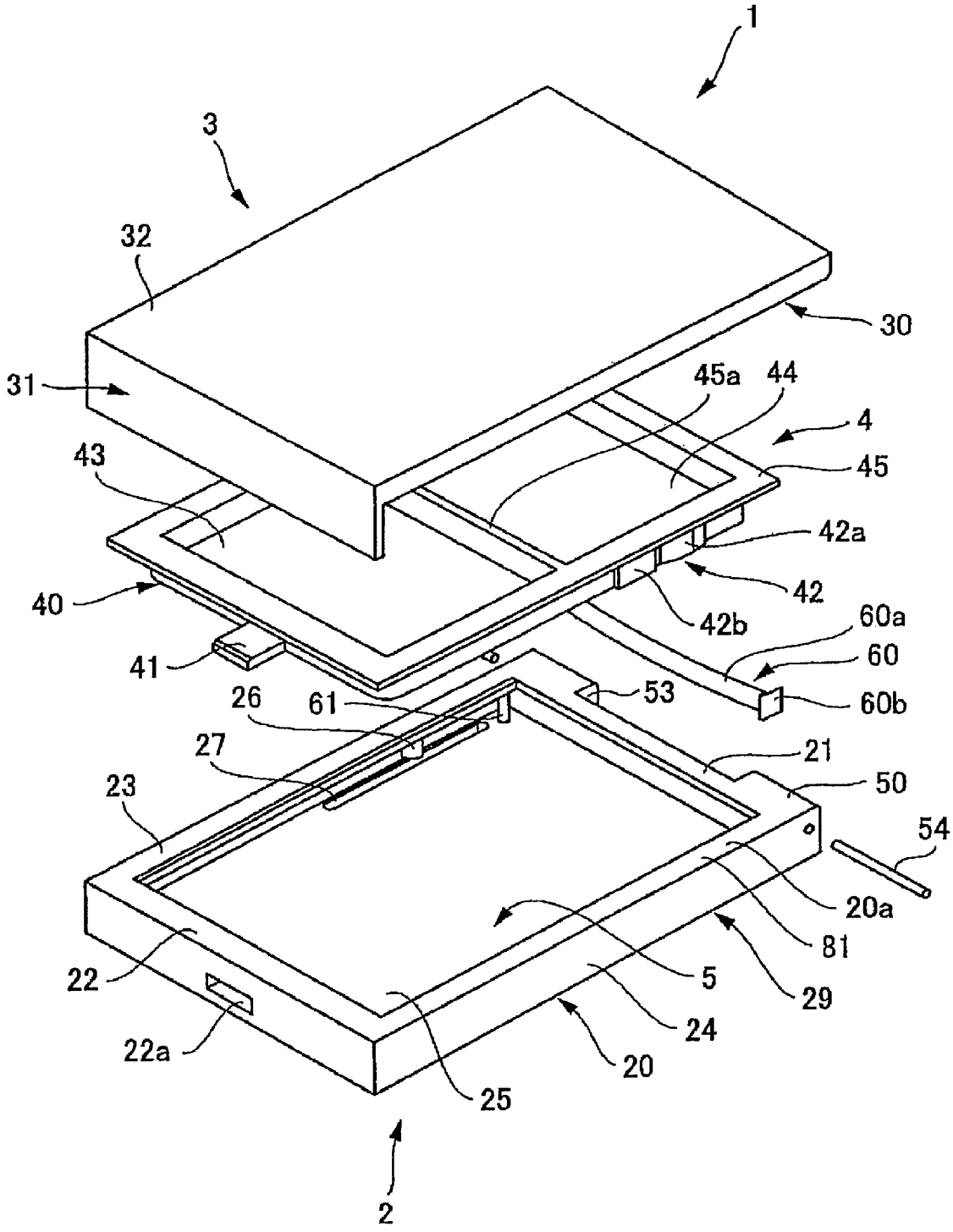
FIG. 1 is an exploded top perspective view of the compact case according to an embodiment of the present invention.
Figure 2:
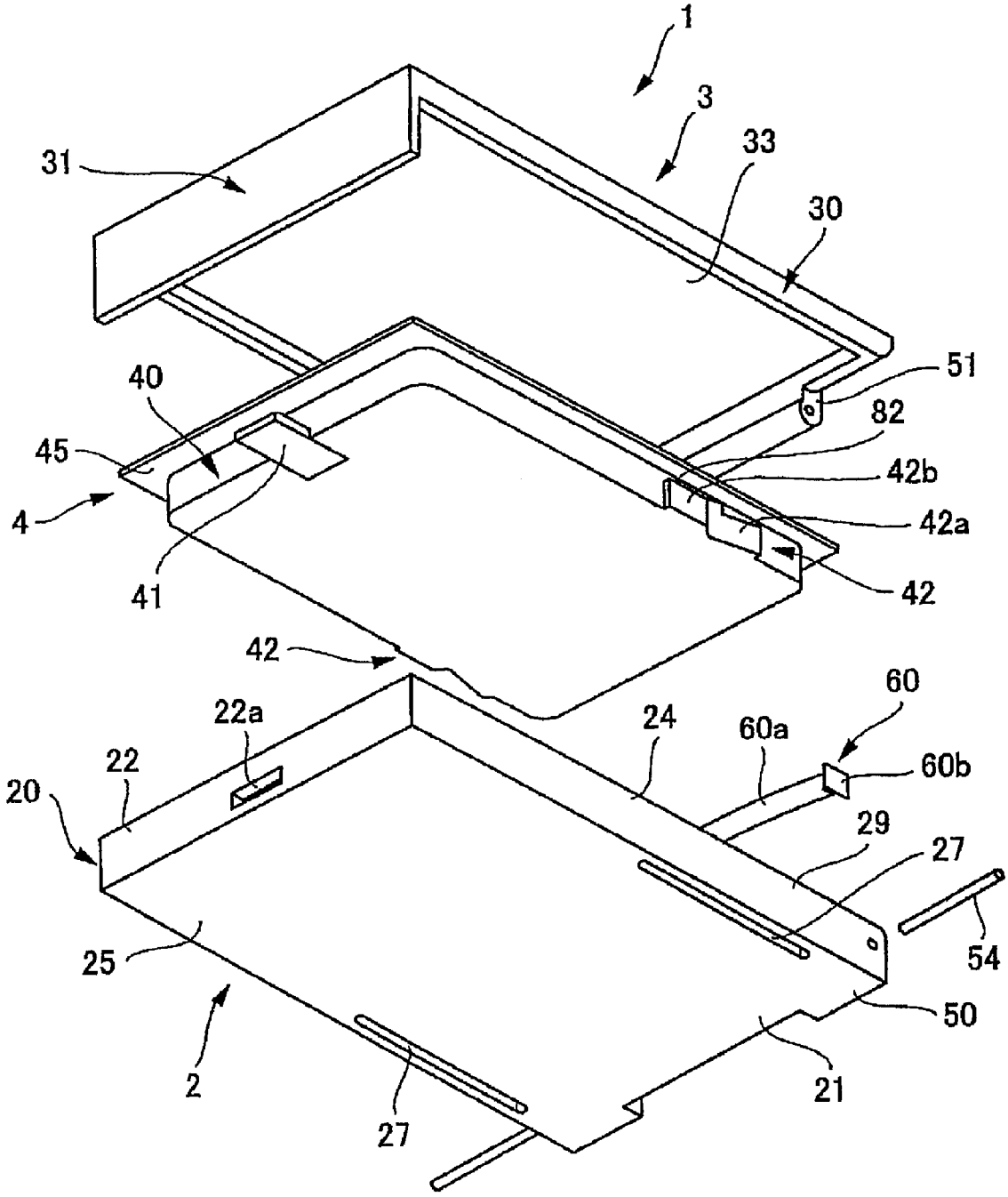
FIG. 2 is an exploded bottom perspective view of the compact case shown in FIG. 1.
Figure 3:
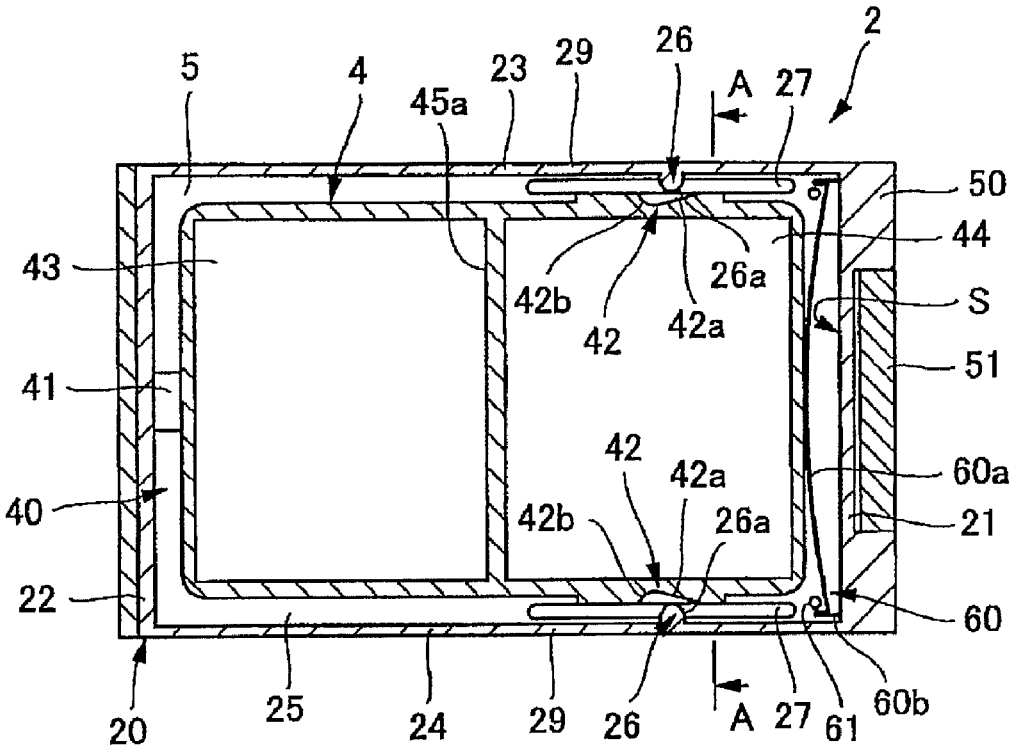
FIG. 3 is a sectional plan view of the compact case shown in FIG. 1.
Figure 4:
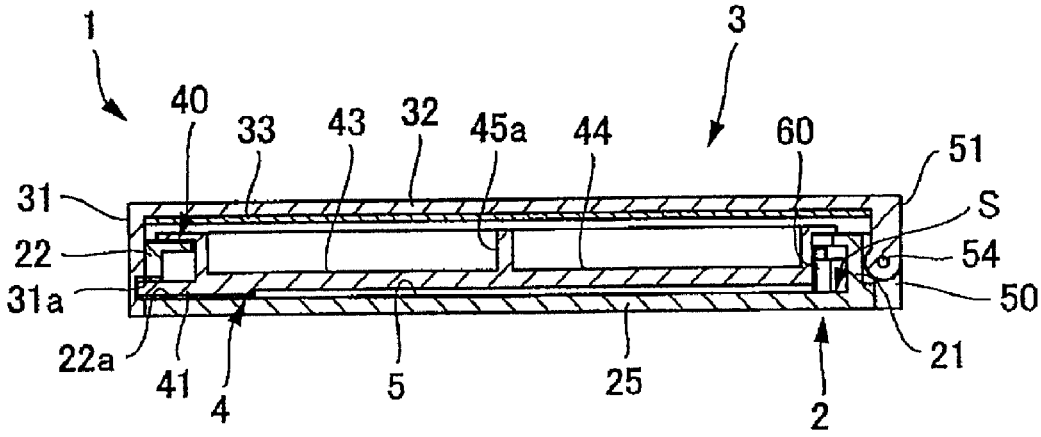
FIG. 4 is a sectional side view of the compact case shown in FIG. 1.

A compact case according to embodiments of the present invention will be described in detail hereinbelow with reference to the accompanying drawings. As shown in FIGS. 1-8, a compact case 1 according to the present embodiment essentially comprises a body 2, a lid 3, and a cosmetic dish 4. The body 2 includes a bottom plate 25, a pair of side walls 23, 24, a rear wall 21, and a pair of pushing walls 29. The lid 3 is coupled to the rear wall 21 of the body 2 and is rotatable with respect to the body 2. A pair of slots 27 is formed at a rear part of the bottom plate 25 of the body 2 along the respective side walls 23, 24. The pair of pushing walls 29 is provided to the side walls 23, 24 respectively in an elastically deformable manner facing the pair of slots 27. The cosmetic dish 4 is installed in the body 2 between the respective side walls 23, 24 so as to be slidable in a forward and rearward direction. The cosmetic dish 4 has a hook 41 coupling the cosmetic dish 4 with the lid 3 in an engageable and disengageable manner to retain the lid 3 at a closed position of the body 2 and releasing the engagement by sliding of the cosmetic dish 4 in the body 2. The body 2 further includes a projection 26 integrally provided to each of the pushing walls 29 of the body 2 facing the cosmetic dish 4. The cosmetic dish 4 includes a slope-defining part 42 integrally provided facing each projection 26 that allows sliding of the cosmetic dish 4 in a forward or rearward direction through sliding of the projection 26 by squeezing the pushing walls 29 inward. It is to be noted that, in the present application, the terms "in a forward direction" and "in a rearward direction" mean respectively "toward an end where engagement of the lid 3 and the body 2 is made" and "toward an end where a hinge mechanism of the compact case 1 is provided". Hereinafter, "in a forward and rearward direction" is sometimes referred to as "in a longitudinal direction" of the body 2/lid 3/cosmetic dish 4.

A space S is provided between the cosmetic dish 4 and the rear wall 21 or the front wall 22 of the body 2. In the space S is disposed an elastically deformable member that is subject to elastic deformation (flexure) by sliding of the cosmetic dish 4 in a forward or rearward direction and that returns the cosmetic dish 4 to a home position with its elastic restoration.

As described above, the compact case 1 essentially has the body 2, the lid 3, and the cosmetic dish 4 installed in the body 2. The body 2 is formed of a synthetic resin material. The body 2 has a circumferential side wall 20 vertically formed on a peripheral edge of the bottom plate 25 that defines the front wall 22, the rear wall 21, and the respective side walls 23, 24. In the illustrative figures, since in the body 2 the respective side walls 23, 24 are made longer than the front wall 22 and the rear wall 21, a plan contour of the circumferential side wall 20 defines a rectangular shape. Alternatively, however, the plan contour of the circumferential side wall 20 may be a square or some other shape. At a top of the circumferential side wall 20 is formed an upper edge 20*a* extending inwardly therefrom.

The lid 3 is rotatably coupled to the body 2. The lid 3 is formed of a synthetic resin material, for example. On a peripheral edge of a top panel 32 of the lid 3 is vertically formed a circumferential wall 30 that defines a dish shape having a plan contour corresponding to that of the body 2. The lid 3 may be shaped to have a plan contour such as a square or some other shape. At the back side of the top panel 32 is disposed a mirror 33 of a plate shape. At a front end of the lid 3 is provided a hanging front wall 31 entirely covering a front surface of the front wall 22 of the body 2.

Figure 5:
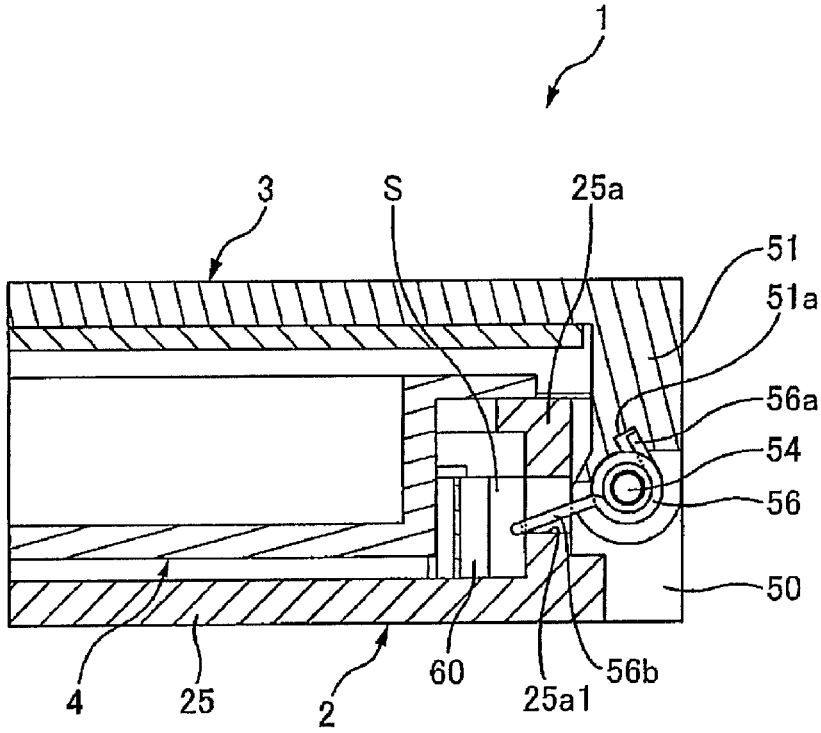
FIG. 5 is a magnified sectional view of a hinge mechanism of the compact case shown in FIG. 4.
Figure 6:
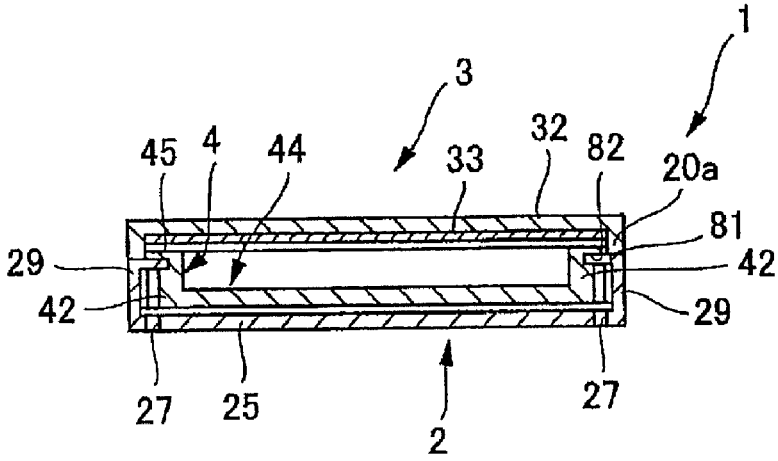
FIG. 6 is a cross-sectional view along a line A-A of the compact case shown in FIG. 3.
Figure 7:
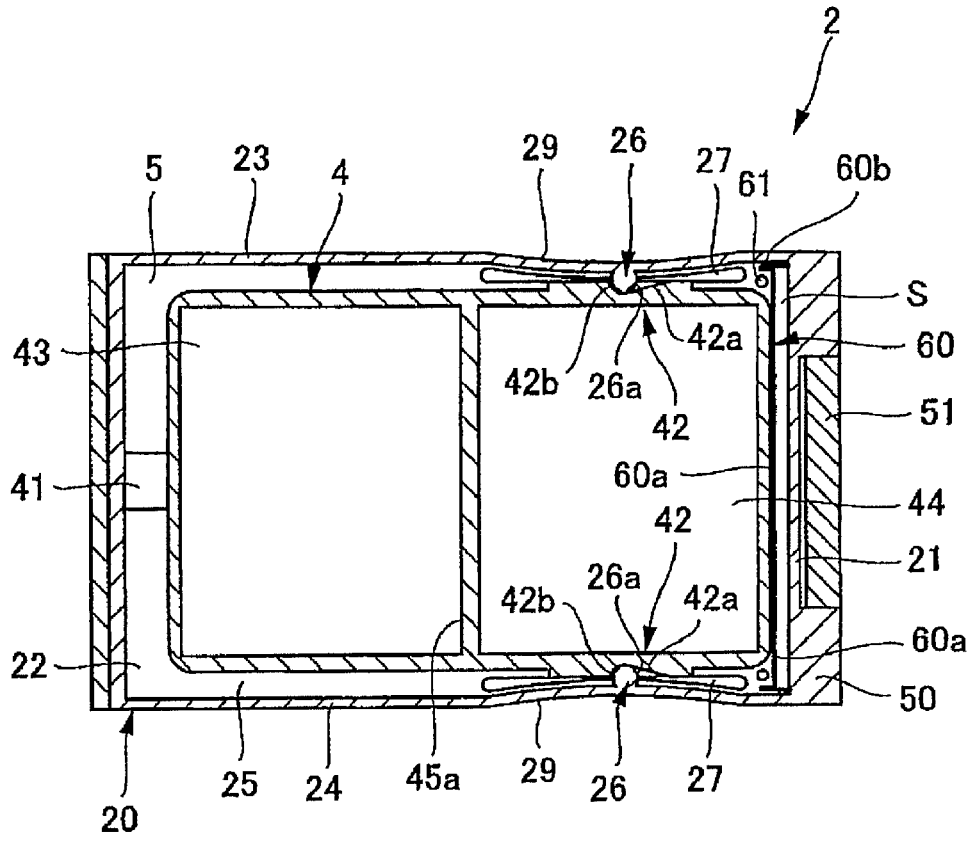
FIG. 7 is a sectional plan view of the compact case shown in FIG. 1 in which the side walls are squeezed.

A pair of hinges 50 is provided to the rear wall 21 of the body 2 at the lateral ends thereof and projecting outward. Between the hinges 50 is defined a recess 53. To the circumferential wall 30 of the lid 3 is provided a hinge block 51 as hanging therefrom so as to be positioned in the recess 53. The hinge block 51 is coupled with each of the hinges 50 with a hinge pin 54. With this structure, the hinge block 51 is rotatably coupled with the hinges 50 so that the lid 3 can be rotated to open and close. As shown in FIG. 5, in the present embodiment, a torsion spring 56 is provided in the hinge block 51 of the lid 3. The torsion spring 56 is a coil spring having first and second extension parts 56*a*, 56*b* at respective ends thereof. The first extension part 56*a* projects into a recess 51*a* formed in the hinge block 51. The second extension part 56*b* is inserted into an aperture 25*a*1 formed through an upright wall 25*a* formed on the bottom plate 25. In the lid-closed condition shown in FIG. 5, the first and the second extension parts 56*a*, 56*b* are positioned so that the torsion spring 56 urges the first and the second extension parts 56*a*, 56*b* apart by torsion stored in the torsion spring 56. When engagement of a hook 41 to be described later with the lid 3 is released, the lid 3 is driven to open by restoration of the torsion spring 56 unaided by fingers of a user or the like. It is to be noted that a hinge structure without the torsion spring 56 may be applied to the compact case 1 of the present invention. Further, the torsion spring 56 can be replaced with other components providing the equivalent function, such as a rubber spring.

In the body 2 is defined a cosmetic dish receptacle 5 surrounded by the circumferential side wall 20. The cosmetic dish 4 is stored in the cosmetic dish receptacle 5. The cosmetic dish 4 is formed into a dish shape using, for example, a synthetic resin material. A flange 45 is formed along a peripheral edge of the cosmetic dish 4. A partition 45*a* is integrally provided to the cosmetic dish 4 extending laterally between the flange 45 at substantially the center of the flange 45 in a long direction thereof that divides the interior of the cosmetic dish 4 into a front compartment and a rear compartment. With this structure, in the cosmetic dish 4, the partition 45*a* defines a first dish part 43 and a second dish part 44 at both sides thereof for storing cosmetic and makeup tools such as a puff. The flange 45 is shaped so that a contour defined by a peripheral edge thereof is smaller than that of the circumferential side wall 20 of the body 2 and can substantially fit the upper edge 20*a* of the circumferential side wall 20. With this structure, when the cosmetic dish 4 is stored in the cosmetic dish receptacle 5, a bottom plate of the peripheral edge portion of the flange 45 can abut on the upper edge 20*a* of the circumferential side wall 20 of the body 2.

An aperture 22*a* is formed in the body 2 so as to pass through the front wall 22 thereof. At a front end 40 of the cosmetic dish 4 is provided a plate-shaped hook 41 that can be inserted into and withdrawn from the aperture 22*a*, extending from an outer surface of the front wall of the first dish part 43 outwardly. The hook 41 has a length sufficient to prevent it from being fully withdrawn from the aperture 22*a* when the cosmetic dish 4 is slid rearward. An engaging part 31*a* as a recess is provided to the hanging front wall 31 of the lid 3 at a back side surface facing the front wall 22 of the body 2, disengageably engaging the hook 41 projecting out of the aperture 22*a*. When the cosmetic dish 4 is slid forward in the cosmetic dish receptacle 5, the hook 41 engages the engaging part 31*a* projecting out of the aperture 22*a* of the front wall 22 of the body 2. The hook 41 and the engaging part 31*a* together constitute a hook part. The hook part maintains engagement of the cosmetic dish 4 with the lid 3 to keep the body in a closed state.

In the body 2 is provided a fitting part that allows fitting of the cosmetic dish 4 so that the cosmetic dish 4 can slide forward and rearward along the respective side walls 23, 24. The fitting part is constructed by a first fitting part 81 formed at the body 2 and a second fitting part 82 formed at the cosmetic dish 4. In the illustrations, the first fitting part 81 is defined by the upper edge 20*a* of the side walls 23, 24 positioned at a rearward side of the body 2. The second fitting part 82 is formed at each of the outer surface of the side walls of the second dish part 43 facing the first fitting part 81. The second fitting part 82 is constructed by a slope-defining part 42 to be described later and the flange 45 as a space between the slope-defining part 42 and the flange 45. The second fitting part 82 defined by the slope-defining part 42 has a predetermined length corresponding to the slope-defining part 42 in a longitudinal direction of the cosmetic dish 4. On installing the cosmetic dish 4 in the body 2, the cosmetic dish 4 is placed in the body 2 from above, and the slope-defining part 42 runs over the upper edge 20*a* to have the first fitting part 81 fit in the second fitting part 42 so as to slide in a longitudinal direction of the body 2. In the construction of the present embodiment, since the above-mentioned hook 41 is inserted in the aperture 22*a*, sliding movement of the cosmetic dish 4 in a longitudinal direction is limited in both a forward and a rearward direction.

The pair of slots 27 is provided to the bottom plate 25 of the body 2 along the respective side walls 23, 24 of the body at a rearward part thereof. Here, the term, "rearward part" of the body 2 means a part of the body 2 from substantially a middle portion of the body 2 in its longitudinal direction to a rear end of the body 2, and the term, "forward part" of the body 2 means a part of the body 2 from substantially a middle portion of the body 2 in its longitudinal direction to a front end of the body 2. In the illustrations, the slots 27 are formed slightly inboard of the respective side walls 23, 24 at the bottom plate 25. Each of the slots 27 is formed as an elongated hole vertically through the bottom plate 25 in a thickness direction extending between substantially a middle of the body in a longitudinal direction thereof and a predetermined position in front of the rear wall 21. According to this structure, the respective side walls 23, 24 of the body 2 facing the slot 27 are configured as pushing walls 29 each allowing elastic deformation.

To the pushing walls 29 are integrally provided a pair of the projections 26 respectively. To the cosmetic dish 4 are integrally provided a pair of the slope-defining parts 42 facing the respective projections 26 to slide the cosmetic dish 4 forward by slidably moving the projections 26.

In the illustrations, the slope-defining parts 42 are formed on the respective outer surfaces of the side walls of the second dish part 44. Each of the slope-defining parts 42 has a slope part 42*a* having a sloped surface gradually approaching the pushing wall 29 toward a rearward direction on the side wall of the second dish part 44 and a stopper 42*b* projectingly formed on an outer surface of the side wall of the second dish part 44 toward the pushing wall 29 at a forward part of the slope part 42*a*.

The projection 26 projectingly formed toward the cosmetic dish 4 has a semi-circular shape in transverse section. The projection 26 has a sloped surface 26*a* extending from the top toward a rearward direction. When the pushing wall 29 is squeezed, the sloped surface 26*a* of the projection 26 abuts the slope part 42*a* and, as the pushing wall 29 elastically deforms inwardly, slides forward along the slope part 42*a*. This sliding movement of the projection 26 applies a force to the slope-defining part 42 for moving rearward. This force makes the cosmetic dish 4 slide rearward through the slope-defining part 42. When a front end of the projection 26 abuts the stopper 42*b*, rearward sliding of the cosmetic dish 4 is terminated.

Between the cosmetic dish 4 and the rear wall 21 or the front wall 22 is defined a space S of predetermined proportions. In the space S is disposed an elastically deforming member that is elastically deformed by sliding of the cosmetic dish 4 and returns the cosmetic dish 4 to a home position prior to squeezing of the pushing wall 29 by its elastic restoration.

In the illustrations, the space S is formed between the rear wall of the second dish part 44 and the rear wall 21 of the body 2. In the space S, a leaf spring 60 is disposed as an elastically deforming member. The leaf spring 60 is made of metal or synthetic resin, for example. At each end of the bottom plate 25 in the space S is provided a holding part 61 for holding the leaf spring 60 with respect to the body 2. The leaf spring 60 has a curved part 60*a* as an elastically deformable thin plate and a hanging part 60*b* provided to each end of the curved part 60*a* to be engaged with the holding part 61 for securing the leaf spring 60 in the space S. The leaf spring 60 fixed in the space S by engagement of the hanging part 60*b* with the holding part 61 is disposed in the space S with the curved part 60*a* thereof curving forward. The apex of the curved part 60*a* abuts an outer surface of the cosmetic dish 4 at the second dish part 44. When the pushing walls 29 are squeezed and the cosmetic dish 4 is slid rearward, the curved part 60*a* abutting the outer surface of the cosmetic dish 4 at the second dish part 44 is elastically deformed in the space S. When the pressing force applied to the pushing wall 29 is released, the curved part 60*a* is elastically restored to its original shape with a reaction force from the holding part 61 against the hanging part 60*b* fixed in the body 2. This restoration of the leaf spring 60 forces the cosmetic dish 4 to slide back forward to its home position.

Next, a description is given of operation of the compact case 1 according to the present embodiment. When manufacturing the compact case 1, the first fitting part 81 and the second fitting part 82 are fitted together while the hook 41 is inserted in the aperture 22*a* to install the cosmetic dish 4 in the cosmetic dish receptacle 5 of the body 2 so that the cosmetic dish 4 is slidable in a forward and rearward direction. Then the hinge pin 54 is inserted through the hinge blocks 51 and the hinge 50 to couple the lid 3 to the body 2 in a rotatable manner.

To open the lid 3, a user holds the compact case 1 at the bottom in the palm of the hand and squeezes the respective pushing walls 29 with the fingers. As a result, the pushing walls 29 elastically deform inward and the sloped surface 26*a* of the projection 26 makes the slope part 42*a* of the slope-defining part 42 slide to move the cosmetic dish 4 rearward. Along with sliding of the cosmetic dish 4 the hook 41 also slides rearward and engagement with the engaging part 31*a* is released. The lid 3 may then be opened with the fingers or the like.

As the cosmetic dish 4 slides rearward, the space S narrows and the leaf spring 60 is elastically deformed by the second dish part 44. When a user stops squeezing the pushing walls 29, the leaf spring 60 is restored elastically. By the restoration of the leaf spring 60, the cosmetic dish 4 slides forward back to its home position prior to squeezing of the pushing walls 29.

When closing the lid 3, the user presses the lid 3 downward at the top with the fingers or the like. Then, the hook 41 is pushed by the engaging part 31*a* to move rearward with the cosmetic dish 4, moving up and over the engaging part 31*a* to engage therewith.

According to the above-described compact case 1, unlike the one mentioned in the "BACKGROUND" section that has as a separate component a sliding piece sliding in a forward and rearward direction for achieving hooking function, the hook 41 and the slope-defining part 42 are provided to the cosmetic dish 4 to transmit pressure applied to the pushing walls 29 directly to the cosmetic dish 4 from the pushing walls 29 through the slope-defining part 42, enabling operations such as opening the lid 3 to be stably carried out. At the same time, the projections 26 are provided to the pushing walls 29 slidably facing the slope-defining part 42, and the pressing applied by squeezing is securely transferred to the cosmetic dish 4 to further improve stability in operation of the compact case 1.

Furthermore, since the hook 41 and the slope-defining part 42 are integrally provided to the cosmetic dish 4, the opening the lid is accomplished with only essential structural components of the compact case 1, i.e., the body 2, the lid 3, and the cosmetic dish 4. Therefore, such structural components as the sliding piece mentioned above are not required, enabling the number of components to be reduced and efficiency in assembly to be improved. Further, manufacturing costs can be reduced and productivity improved.

Since the projection 26 is provided to the pushing wall 29, the projection 26 securely slides along the slope part 42*a* even if the slope part 42*a* is formed as a relatively slow inclination. Therefore, a distance between the cosmetic dish 4 and the side walls 23, 24 can be made smaller and formed into various shapes, and production of aesthetic compact cases is made possible.

Since the leaf spring 60 is provided between the cosmetic dish 4 and the rear wall 21 of the body 2, when a user stops squeezing the pushing walls 29, the cosmetic dish 4 can be pushed back to its home position to provide secure closing of the lid 3.

In the present embodiment, the hanging front wall 31 is provided to the lid 3. Accordingly, the hanging front wall 31 covers the front wall 22 of the body 2 entirely when the lid 3 is closed, giving the compact case 1 as a whole a superior appearance. Further, the hook 41 is provided to the front end 40 of the cosmetic dish 4 and projects out of the aperture 22*a* of the front wall 22 of the body 2, with the effect that when a user uses the compact case 1 for makeup it is unlikely that scattered cosmetic gets deposited around the aperture 22*a* and the hook 41. Therefore, trouble in operation of opening/closing of the lid 3 can be effectively prevented.

In the present embodiment, the cosmetic dish 4 has the two dish parts 43, 44. However, the configuration of the cosmetic dish 4 is not limited thereto, and thus, for example, the cosmetic dish 4 may have only one dish part.

Figure 8:
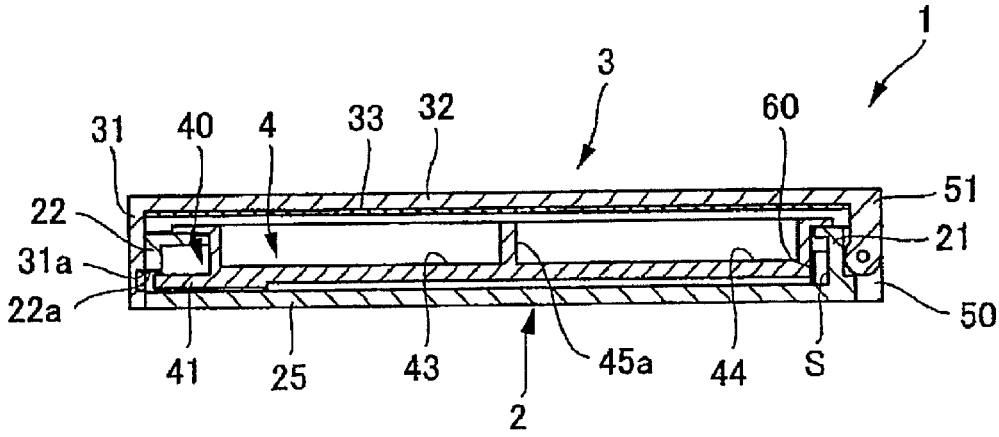
FIG. 8 is a sectional side view of the compact case shown in FIG. 7 with the side walls squeezed.
Figure 9:
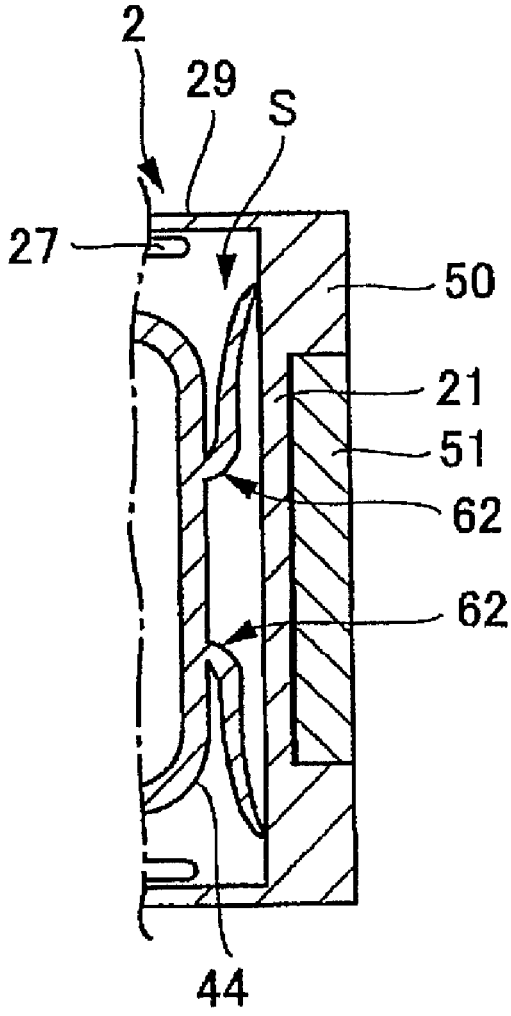
FIG. 9 is a plan view with a part in a space magnified to illustrate the compact case shown in FIG. 1 with a bow-shaped spring as an elastically deforming part provided thereto.
Figure 10A:
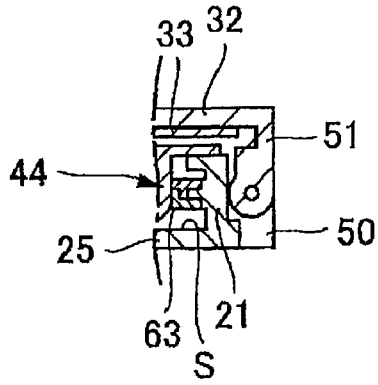
FIG. 10A is a sectional side view with a part in the space magnified to illustrate the compact case shown in FIG. 1 with a rubber spring as an elastically deforming part provided thereto.
Figure 10B:
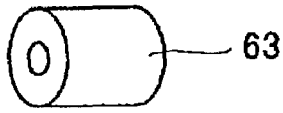
FIG. 10B is a perspective view of an example of the rubber spring shown in FIG. 10A.

In the present embodiment, the leaf spring 60 is disposed in the space S as an elastically deforming member. However, the elastically deforming member may be other components than the leaf spring 60. For example, as shown in FIG. 8, a bow-shaped spring 62 of synthetic resin may be integrally provided to the cosmetic dish 4. Such a construction enables further reduction of the number of the components while retaining operational stability, and ease of assembly and productivity are further improved. Alternatively, other known springs such as a rubber spring 63 as shown in FIG. 9 may be disposed in the space S.

Figure 11:
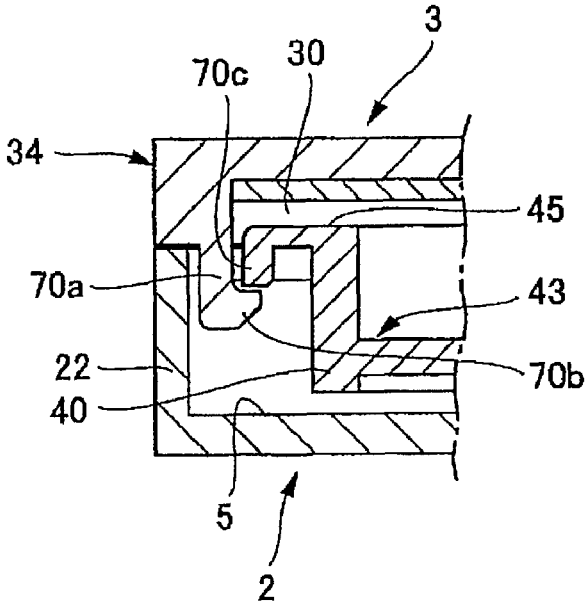
FIG. 11 is a sectional side view with a magnified part illustrating a modified example of a hook part of the compact case according to a first embodiment of the present invention.

A variation of the hook part of the compact case 1 according to the present embodiment is described with reference to FIG. 11.

To the lid 3 is provided a front wall part 34 instead of the hanging front wall 31. The front wall part 34 is formed as a part of the circumferential wall 30 at a front end thereof, the circumferential wall 30 being formed to have a dish shape with a plan contour corresponding to the body 2. The front wall part 34 is also formed so that it defines substantially a flush surface flush with an outer surface of the front wall 22 of the body when the lid 3 is closed. To the lid 3 is provided a downward-projecting claw 70*a* depending into the interior of the cosmetic dish receptacle 5. The claw 70*a* has a rearward-projecting hook 70*b* formed at a bottom end thereof. At a front end of a flange 45 of the cosmetic dish 4 is formed a downward-projecting engaging part 70*c* that is engaged with the hook 70*b*. Together, the hook 70*b* and the engaging part 70*c* constitute the hook part.

When opening the lid 3, squeezing the pushing walls 29 causes the cosmetic dish 4 to slide rearward, which further causes the engaging part 70*c* to move rearward to release engagement of the engaging part 70*c* with the hook 70*b*.

Next, a detailed description is given of the compact case according to the second embodiment of the present invention. For clarity and conciseness, only those parts that are different from those of the first embodiment will be described hereinbelow.

Figure 12:
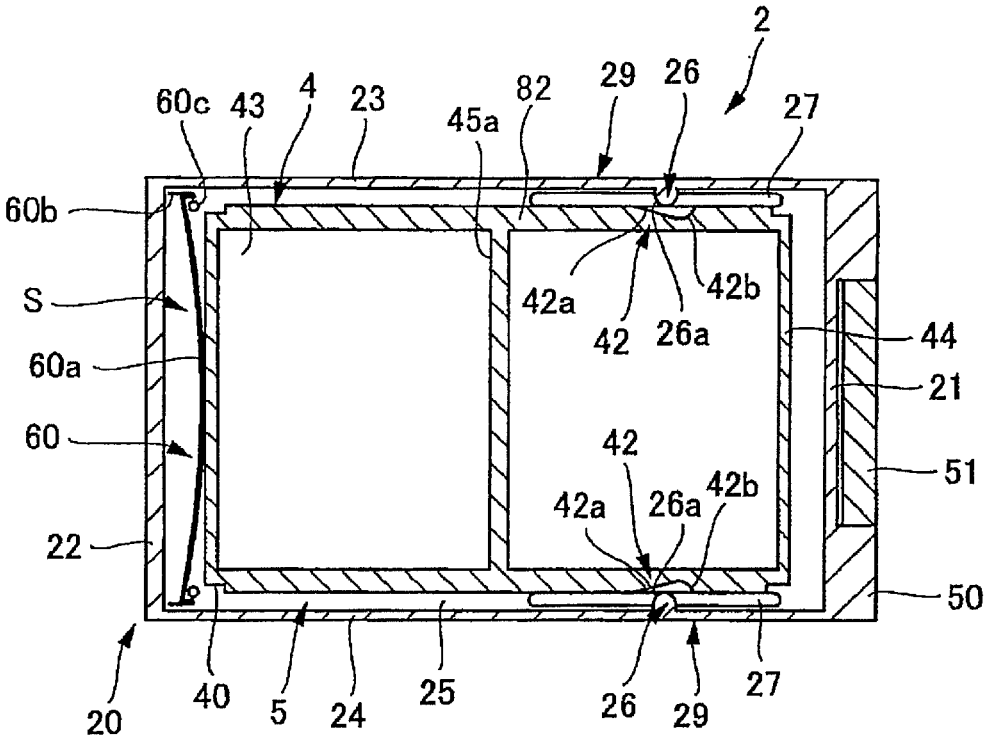
FIG. 12 is a sectional plan view of the compact case according to a second embodiment of the present invention.
Figure 13:
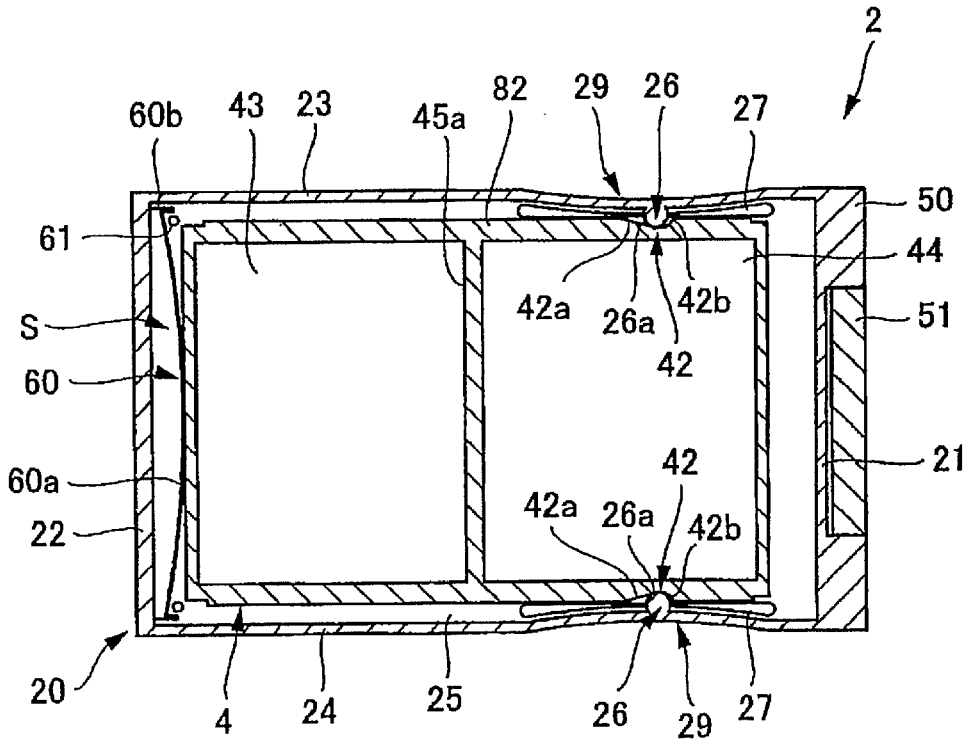
FIG. 13 is a sectional plan view illustrating the compact case shown in FIG. 12 with the pushing walls squeezed.
Figure 14:
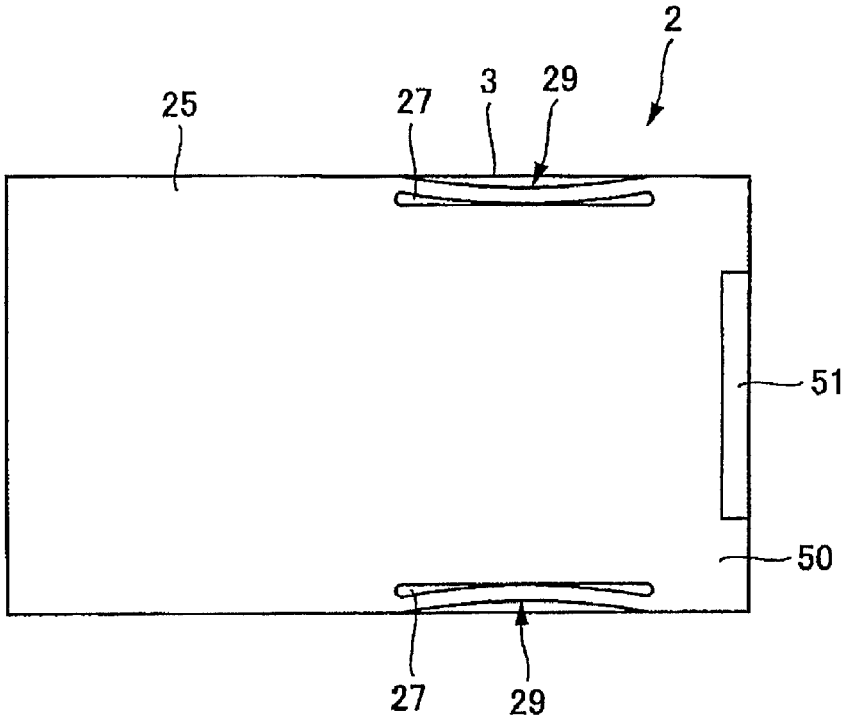
FIG. 14 is a back side view of the compact case shown in FIG. 13 with the pushing walls squeezed.

The compact case 1 of the present embodiment has a construction in which squeezing of the pushing walls 29 causes the cosmetic dish 4 to slide forward. As shown in FIGS. 12 to 14, in the compact case 1, the side wall of the cosmetic dish 4 is extended over substantially a full length thereof in a longitudinal direction. The slope-defining part 42 is provided to the side wall of the cosmetic dish 4. The slope part 42*a* of the slope-defining part 42 is formed in an outer surface of the side wall of the second dish part 44 as a surface that gradually slopes inwardly as well as rearward. The stopper 42*b* is formed with the side wall of the cosmetic dish 4, provided adjacent a rear end of the slope part 42*a*. The projection 26 has a sloped surface 26*a* extending from the top forward. In opening the lid 3, the pushing walls 29 are elastically deformed inward and the sloped surface 26*a* of the projection 26 causes the slope part 42*a* to slide. This movement of the slope part 42*a* further causes the cosmetic dish 4 to slide forward via the slope-defining part 42.

In the present embodiment, the fitting part is provided to the cosmetic dish receptacle 5 over substantially the full length thereof in a longitudinal direction. More specifically, the second fitting part 82 is constituted by the side wall of the cosmetic dish 4 that extends outward and the flange 45, which face each other across a space. The first fitting part 81 is formed at the upper edge 20*a* of the body 2 facing the second fitting part 82.

The space S is provided between the cosmetic dish 4 and the front wall 22 of the body 2, in which the leaf spring 60 is disposed. When the cosmetic dish 4 slides forward to constrict the space S, the leaf spring 60 is pressed by the cosmetic dish 4 and is elastically deformed in the space S. When the pushing walls 29 are released, the leaf spring 60 is elastically restored and causes the cosmetic dish 4 to slide rearward back to its home position.

Figure 15:
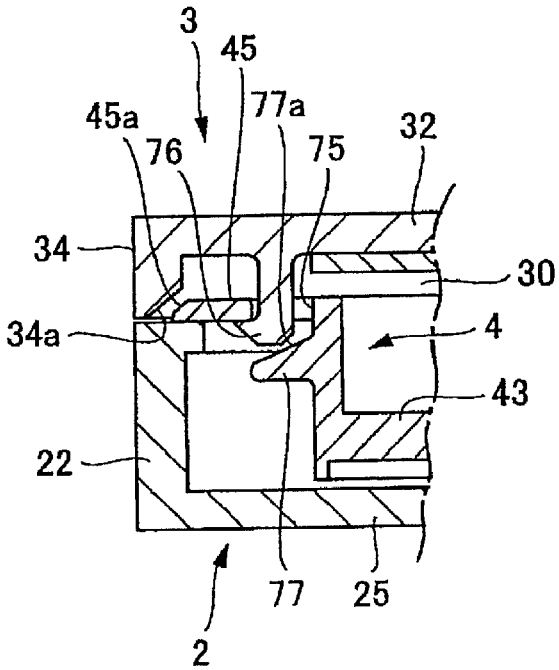
FIG. 15 is a sectional side view with a magnified part illustrating a hook part of the compact case according to the second embodiment of the present invention.
Figure 16:
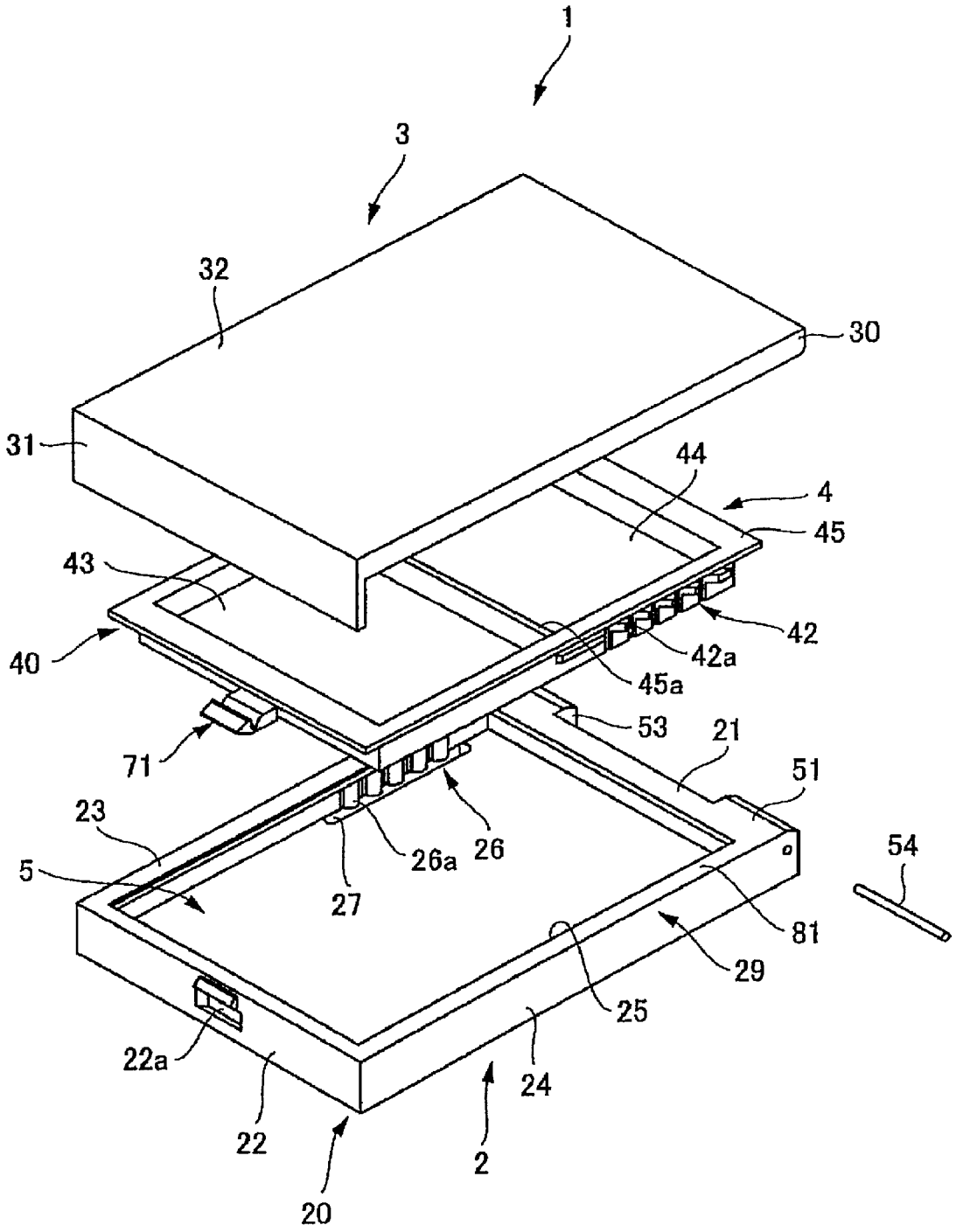
FIG. 16 is an exploded upper perspective view of the compact case according to a third embodiment of the present invention.
Figure 17:
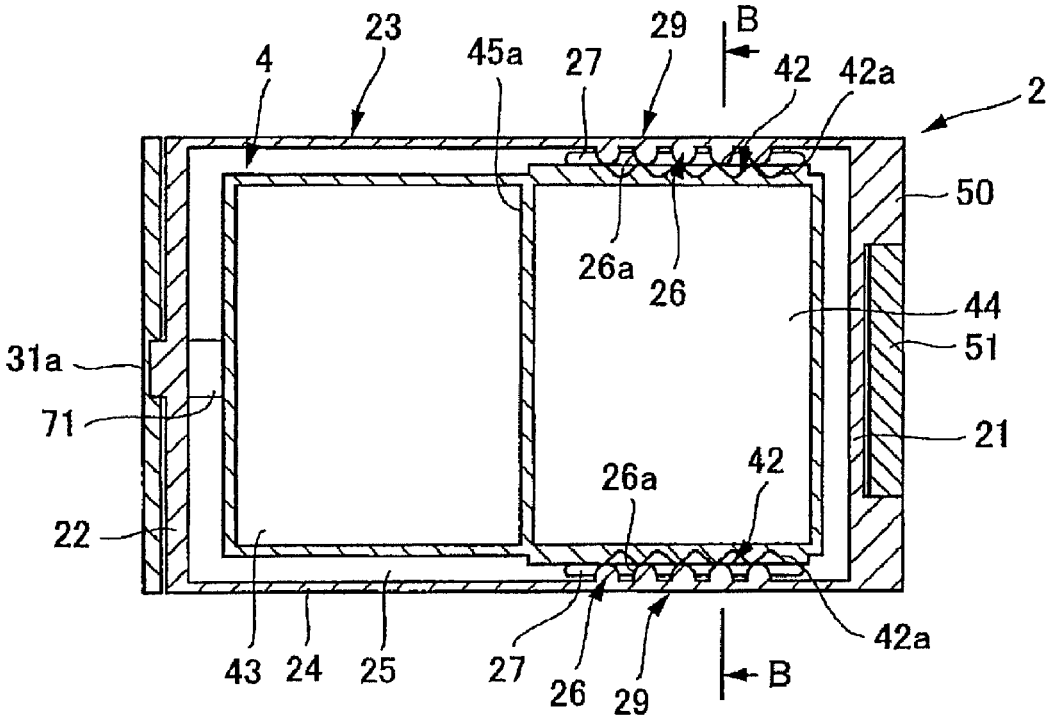
FIG. 17 is a sectional plan view of the compact case shown in FIG. 16.
Figure 18:
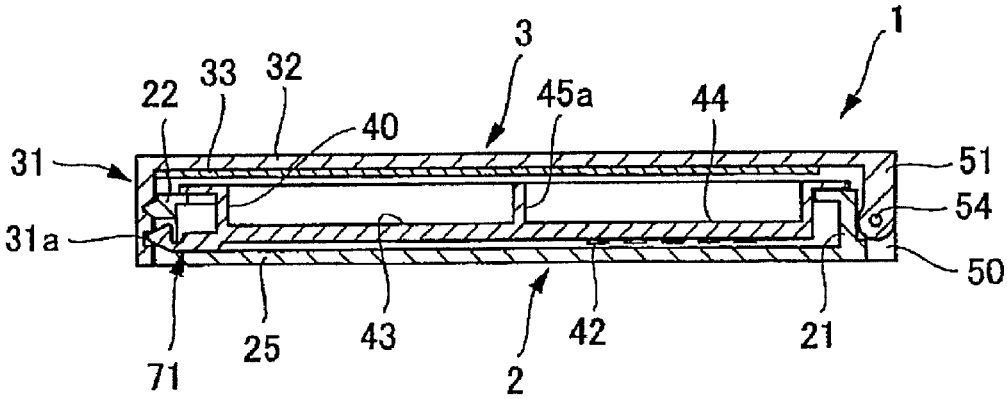
FIG. 18 is a sectional side view of the compact case shown in FIG. 16.
Figure 19:
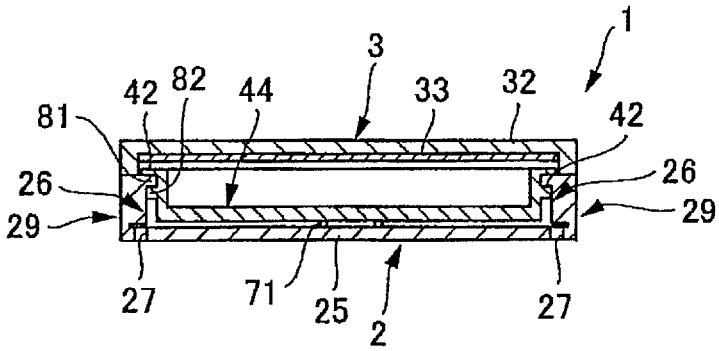
FIG. 19 is a cross-sectional view along a line B-B of the compact case shown in FIG. 17.

A construction of the hook part of the compact case 1 according to the present embodiment is shown in FIG. 15. The lid 3 has the front wall part 34 usually employed. The hook part is defined between the lid 3 and the cosmetic dish 4. The hook part is formed with the engaging part 75 and the hook 76. The engaging part 75 is provided to a front end of the flange 45 of the cosmetic dish 4 as an aperture through which the hook 76 to be described later is allowed to be inserted and to be drawn as passing therethrough. The hook 76 is provided to the top panel 32 of the lid 3 and projects downward therefrom, the hook 76 being inserted into the engaging part 75 to correlate with the same engageably and disengageably by means of forward projection of a front end.

The front wall of the first dish part 43 has a projecting piece 77 that is projectingly formed at a forward part and has a sloped surface 77*a* formed on the top and ascending from a forward part to a rearward part.

Further, a first slope-defining part 45*a* is provided to a front end of the flange 45, and a second slope-defining part 34*a* is provided inside the front wall part 34 of the lid 3 corresponding to the first slope-defining part 45*a*.

When opening the lid 3, the engaging part 75 slides forward with the cosmetic dish 4 to be discharged from the hook 76, and engagement of the hook part is released. Along with this action, the projecting piece 77 that abuts a rear part of the hook 76 slides while pressing up the hook 76 that is released from engagement with the engaging part 75. At the same time, the first slope-defining part 45*a* abuts the second slope-defining part 34*a* to press the same upward above a top surface of the front wall 22. A user may then open the lid 3 by pulling up the front wall part 34 of the lid 3 with the fingers or the like.

When closing the lid 3, a user presses the lid 3 down toward the body 2. During this action, the hook 76 causes the cosmetic dish 4 to slide forward as the hook 76 slides down on the sloped surface 77*a* of the engaging part 75 and then the hook 76 is engaged with the engaging part 75 smoothly.

The hook part can be configured without the projecting piece 77 described above. In this construction, the lid 3 is lifted with only the first slope-defining part 45*a* and the second slope-defining part 34*a* after engagement of the hook part is released.

Next, a detailed description is given of the compact case 1 according to a third embodiment of the present invention. Here again, only structural differences from the first embodiment are described for clarity and conciseness.

In the present embodiment, as shown in FIGS. 16 to 19, a plurality of the projections 26 is provided to the body 2. Multiple slope-defining parts 42 are provided corresponding to the projections 26.

The projections 26 are integrally formed on the pushing walls 29 so as to project toward the cosmetic dish 4. In the illustrations, each projection 26 has a semi-circular shape in transverse section. Each projection 26 has a sloped surface 26*a* extending from the top toward a rearward direction. Five pieces of the projections 26 are disposed side by side in a longitudinal direction of the body 2 at substantially equal intervals.

The side wall of the cosmetic dish 4 positioned at a rear part of the body 2 is extended outward. The slope-defining parts 42 are integrally provided on an outer surface of the extended side wall of the second dish part 44 facing the projections 26. Each slope-defining part 42 is sized to fit the projection 26, recessed to a V-shaped transversal cross-section. Five pieces of the slope-defining parts 42 are provided on the side wall of the second dish part 44 side by side in a longitudinal direction corresponding to the projections 26.

Each of the slope-defining parts 42 has a slope part 42*a* having a sloped surface gradually approaching the pushing wall 29 toward a forward direction. A front end of the slope part 42*a* abuts the sloped surface 26*a* of the projection 26. Squeezing the pushing walls 29 in this situation causes the pushing walls 29 to elastically deform inward and the sloped surface 26*a* of the projection 26 abutting a front part of the slope part 42*a* slides rearward on the slope part 42*a*. By this action, a force driving the slope-defining part 42 forward is generated. This driving force causes the cosmetic dish 4 to slide forward via the slope-defining part 42. When the projection 26 is entirely fitted in the slope-defining part 42, forward sliding of the cosmetic dish 4 is terminated.

In the present embodiment, the fitting part is provided at a rear part of the body 2. More specifically, the second fitting part 82 is constituted by the side wall of the cosmetic dish 4 that extends outward and the flange 45, which face each other across a space. The first fitting part 81 is formed by the upper edge 20*a* at a rear part of the body 2 facing the second fitting part 82.

In the present embodiment, the slope-defining part 42 is sized such that the projection 26 can be substantially fitted into the slope-defining part 42 and a plurality of the slope-defining parts 42 are provided on a side surface of the cosmetic dish 4. Accordingly, when the multiple projections 26 cause the multiple slope-defining parts 42 to slide, sliding movement of the cosmetic dish 4 can be stabilized even more than in a structure with a single set of the projection 26 and the slope-defining part 42. Furthermore, a user can stably open the lid 3 regardless of which part of the pushing walls 29 the user presses.

The present embodiment as described employs a construction in which the cosmetic dish 4 is caused to slide forward. However, modifications can be made to allow rearward sliding of the cosmetic dish 4. In this modification, for example, the sloped surface 26*a* is formed rearward from the top middle of the same in a longitudinal direction whereas the slope part 42*a* is formed rearward from the middle thereof in a longitudinal direction. In this case, a front end of the sloped surface 26 is positioned to abut a rear end of the slope part 42*a*.

As described in relation to the first and the second embodiments, a variety of hook parts may be employed in the present embodiment according to the direction of movement of the cosmetic dish 4.

Figure 20:
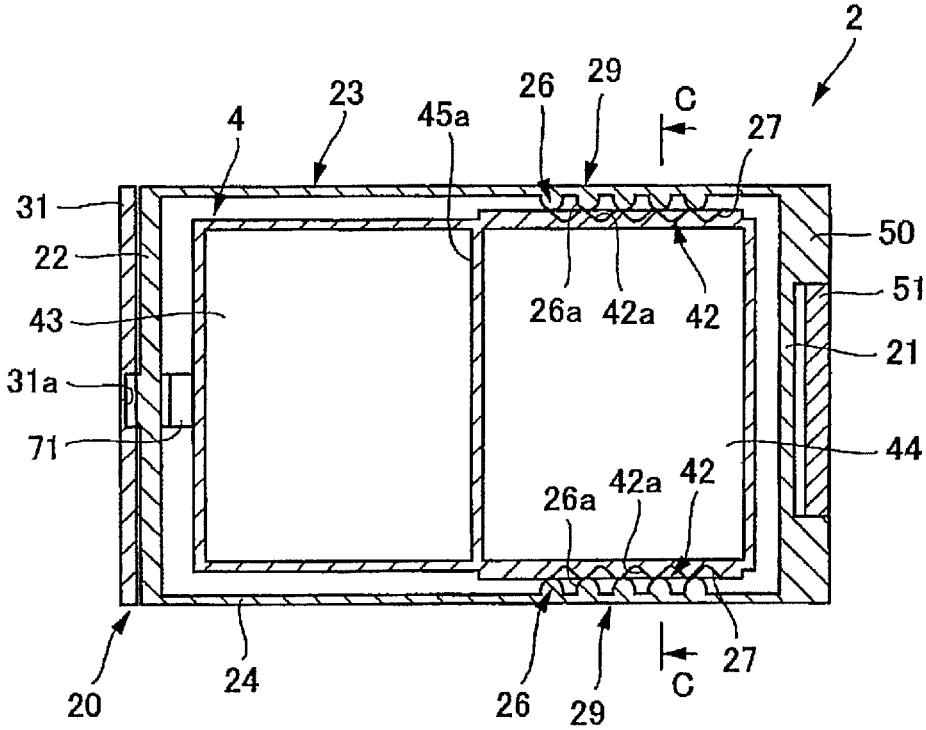
FIG. 20 is a sectional plan view of modified slots in the compact case according to the third embodiment of the present invention.
Figure 21:
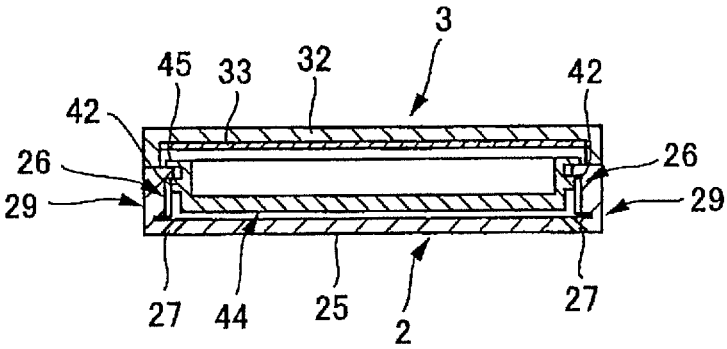
FIG. 21 is a cross-sectional view along a line C-C of the compact case shown in FIG. 20.

Next, an example of a modification of the slot 27 of the compact case 1 according to the present embodiment is described. As shown in FIGS. 20 and 21, in this modification, the slot 27 is formed from substantially the middle of the body 2 in a longitudinal direction to a predetermined position at a forward side of the rear wall 21 as a hole through the bottom plate 25 along an axis gradually slanting inward from the bottom to the top of the bottom plate 25. According to this structure, the interior of the cosmetic dish receptacle 5 cannot seen from the bottom of the body 2 through the slot 27, which enables manufacturing of the compact case 1 having a more aesthetic appearance.

In the above first to third embodiments, the slot 27 is formed at a rearward side of the bottom plate 25 of the body 2. Alternatively, however, the slot 27 may be formed at a forward side of the bottom plate 25. In this case, the pushing walls 29 are provided to the side walls 23, 24 of the body 2 at a forward side thereof, and the projections 26 and the slope-defining parts 42 are formed at the side walls 23, 24.

In the first to third embodiments, the projection 26 is provided to the pushing wall 29, and the slope-defining part 42 is provided to the cosmetic dish 4 facing the projection 26. However, it is possible to provide the projection 26 to the cosmetic dish 4, and to provide the corresponding slope-defining part 42 to the pushing wall 29.

In the first to third embodiments, the projection 26 is shaped as a projection having a semi-circular shape in transverse section from the respective pushing wall 29 toward the cosmetic dish 4. However, the shape of the projection 26 is not necessarily limited to this structure. Instead of the projection 26, it is sufficient to form the sloped surface 26*a* on an outer surface of the side wall of the pushing wall 29 or the cosmetic dish 4 corresponding to the slope part 42*a*.

In the first to third embodiments, the fitting part defined by the first fitting part and the second fitting part is shown as a fitting structure of the body 2 and the cosmetic dish 4. However, the fitting structure need only be one for enabling fitting of the cosmetic dish 4 into the body 2. For example, a fitting structure is possible in which a first projection is provided on an outer surface of the side wall of the cosmetic dish 4 at a suitable position and a second projection is provided to the body 2 facing the first projection for engagement with the same. Specifically, as described in relation to the embodiments, if the fitting structure for holding the cosmetic dish 4 in the body 2 is constituted by the first fitting part 81 formed with the upper edge 20*a* and the second fitting part 82 formed as a space between the flange 45 and the side wall of the cosmetic dish 4 (including the slope-defining part 42), it is not necessary to provide a separate component for the fitting, and producibility of the compact case 1 can be further improved.

Although the present invention has been described in detail hereinabove based on the embodiments thereof referring to the accompanying drawings, the present invention is not to be construed as being limited to the above embodiments. It is also to be understood that any variants and equivalents fall under the scope of the present invention without departing from the scope and spirit of the present invention.

What is claimed is:

1. A compact case, comprising:

a body having a bottom plate, a rear wall provided at a rear end of the bottom plate, a pair of side walls provided at respective side ends of the bottom plate, a pair of slots formed in the bottom plate at a front side part or a rear side part thereof along the respective side walls, a pair of elastically deformable pushing walls formed in the respective side walls facing the respective slots;

a lid provided to the rear wall of the body and rotatable with respect to the body;

a cosmetic dish that fits into the body between the respective side walls thereof and slidable in a longitudinal direction of the body;

a hook part provided between the cosmetic dish and the lid engageably and disengageably engaging the cosmetic dish with the lid so as to hold the lid at a closed position with respect to the body and to release the engagement of the cosmetic dish with the lid through sliding movement of the cosmetic dish;

a projection integrally provided to one of an inner surface of the pushing wall and the cosmetic dish; and a slope-defining part facing the projection and integrally provided to one of the cosmetic dish and the inner surface of the pushing wall, wherein squeezing the pushing wall causes the projection to abut the slope-defining part and to move slidably to make the cosmetic dish slide forward or rearward via the slope-defining part.

2. The compact case according to claim 1, wherein the slope-defining part has a sloped surface abutting the projection, the sloped surface being inclined in one of a forward and a rearward direction of the body and the cosmetic dish.

3. The compact case according to claim 1, wherein a plurality of the projections and a plurality of the slope-defining parts corresponding to the projections are provided.

4. The compact case according to claim 1, wherein a space is defined between the cosmetic dish and one of the rear wall and the front wall of the body, and wherein an elastically deforming member is disposed in the space, the elastically deforming member being elastically deformed by the cosmetic dish when the cosmetic dish is slid forward or rearward and being elastically restored back to a home position.

5. The compact case according to claim 1, wherein a hanging front wall is provided to the lid at a front end thereof, the hanging front wall covering an entire front surface of the front wall of the body.

6. A compact case, comprising:

a body having a bottom plate, a rear wall provided at a rear end of the bottom plate, a pair of side walls provided at respective side ends of the bottom plate, a pair of slots formed in the bottom plate at a front side part or a rear side part thereof along the respective side walls, a pair of elastically deformable pushing walls formed in the respective side walls facing the respective slots;

a lid provided to the rear wall of the body and rotatable with respect to the body;

a cosmetic dish that fits into the body between the respective side walls thereof and slidable in a longitudinal direction of the body;

a hook part provided between the cosmetic dish and the lid engageably and disengageably engaging the cosmetic dish with the lid so as to hold the lid at a closed position with respect to the body and to release the engagement of the cosmetic dish with the lid through sliding movement of the cosmetic dish, the hook part protruding from the cosmetic dish through the body and selectively engaging the lid;

a projection integrally provided to one of an inner surface of the pushing wall and the cosmetic dish; and a slope-defining part facing the projection and integrally provided to one of the cosmetic dish and the inner surface of the pushing wall, wherein squeezing the pushing wall causes the projection to move slidably to make the cosmetic dish slide forward or rearward via the slope-defining part.

7. The compact case according to claim 6, wherein the slope-defining part has a sloped surface abutting the projection, the sloped surface being inclined in one of a forward and a rearward direction of the body and the cosmetic dish.

8. The compact case according to claim 6, wherein a plurality of the projections and a plurality of the slope-defining parts corresponding to the projections are provided.

9. The compact case according to claim 6, wherein a space is defined between the cosmetic dish and one of the rear wall and the front wall of the body, and wherein an elastically deforming member is disposed in the space, the elastically deforming member being elastically deformed by the cosmetic dish when the cosmetic dish is slid forward or rearward and being elastically restored back to a home position.

10. The compact case according to claim 6, wherein a hanging front wall is provided to the lid at a front end thereof, the hanging front wall covering an entire front surface of the front wall of the body.

* * * * *